US005603280A

United States Patent [19]

Shackelford, Jr.

[11] Patent Number: 5,603,280

[45] Date of Patent: Feb. 18, 1997

[54] BOAT MOORING APPARATUS

[76] Inventor: Francis H. Shackelford, Jr., Hwy. 123 South, Hookerton, N.C. 28538

[21] Appl. No.: 357,427

[22] Filed: Dec. 16, 1994

[51] Int. Cl.[6] ..... B63B 21/00

[52] U.S. Cl. ..... 114/230

[58] Field of Search ..... 114/219, 230, 114/220, 112, 204; 104/138.1, 108, 140, 96, 106, 107, 109, 146; 16/87 R, 87.4 R–87.8, 91, 93 R, 94 R, 95 R, 96 R, 97, 98, 102, 106, 107; 244/116, 216

[56] References Cited

U.S. PATENT DOCUMENTS

| | | | |
|---|---|---|---|
| 1,695,674 | 12/1928 | Wilson | 114/112 |
| 2,808,016 | 10/1957 | Jarnot | 114/230 |
| 2,979,014 | 4/1961 | Yordi | 114/230 |
| 2,990,803 | 7/1961 | Henderson | 114/230 |
| 3,060,885 | 10/1962 | Nolf | 114/230 |
| 3,177,839 | 4/1965 | Nolf | 114/230 |
| 3,830,452 | 8/1974 | Seay | 244/116 |
| 5,014,638 | 5/1991 | Ilves et al. | 114/230 |
| 5,301,628 | 4/1994 | Daskalides | 114/230 |

FOREIGN PATENT DOCUMENTS

| | | | |
|---|---|---|---|
| 230298 | 3/1925 | United Kingdom | 16/87.8 |
| 588394 | 5/1947 | United Kingdom | 16/87.8 |

*Primary Examiner*—Edwin L. Swinehart
*Attorney, Agent, or Firm*—Rosenthal & Putterman

[57] ABSTRACT

A boat mooring system includes a track mounted to a piling. A carriage is mounted for movement within the track and an elongate rod is connected thereto. A mooring ring is mounted to the carriage or the rod. A float is mounted to the lower end of the rod so that when the entire assembly floats up and down with the tide the relationship between a boat moored thereto and the mooring ring is independent of the tide.

16 Claims, 5 Drawing Sheets

BOAT MOORING APPARATUS

FIELD OF THE INVENTION

This invention relates generally to the field of boat mooring devices and more particularly to boat mooring devices which automatically maintain a predetermined relationship between the boat and the mooring point independent of tide.

BACKGROUND OF THE INVENTION

It well known to secure a boat to a dock by means of ropes and rubber fenders. However, the variation in water level at the dock at the result of the tide will often place undue stresses on the boat and/or the dock and damage can result.

In response to the foregoing, various systems have been devised in order to attempt to solve this problem. For example, Daskalides U.S. Pat. No. 5,301,628 discloses one such boat docking system wherein a tubular housing defines a cavity and is mounted to the mooring post. The tubular housing includes an elongate slot that extends along substantially the entire length of the housing. A series of three tubes are adapted to slide up and down within the cavity. The first tube mounts a ring to which the boat is connected that projects through the front wall slot and beyond the housing front wall for receiving the mooring line. A second tube is provided and is adapted to be cut to a length equal to the distance between the boat's water line to the height of the cleat. The third tube is the floatation tube and is mounted below the second tube. The ring is raised and lowered with the tide. The tubes are threaded to receive a rod that holds the entire assembly together.

A similar device is disclosed in Jarnot U.S. Pat. No. 5,014,016 wherein an elongate tubular cylindrical member is mounted against the outer surface of the vertical pier of a dock. The tubular member is mounted to the pier so that it extends above and below the surface of the water and includes an elongate longitudinal guide slot extending along it's length. An elongate cylindrical float is positioned within the cylindrical member and has a solid bottom. An elongate L-shaped rod is positioned within the float so that one end is connected to the bottom of the float and the other end which mounts the mooring bolt extends upward and through the top of the float and out through the slot. The foregoing docking systems have not been widely adopted due to a number of drawbacks and deficiencies inherent in their design. For example, upon examination of the patents, it becomes clear that the lower portion of the housing or tube is mounted beneath the water or the apparatus that moves therein is at least partially submerged. The foregoing permits barnacles, sea weed and other marine life to grow thereon which results in a clogging of the channel in which the tubes travel and if left unattended for only a relatively short period of time, will result in an inoperable device which is frozen in place, thus causing damage to the boat and/or the dock.

Another boat mooring device has been proposed in Ilves et al. U.S. Pat. No. 5,014,638 wherein a vertically mounted slider device is mounted to a dock post, a fixed mount member is mounted on the boat and a connecting unit extends therebetween. The slider device comprises a circular rod that is connected to the mooring post. A collar is adapted to slide up and down on the rod. A flange member is connected to the collar and mounts both a float apparatus that raises and lowers the level of the collar with the water level and the connecting unit. The boat mounts a ball such as is used in connection with pulling a trailer. The connecting unit is a complex device that automatically adjusts its length after it has been put in place between the boat and the dock. This device has also not found wide acceptance in the marketplace, probably due to relatively high cost, complexity and the need for the boat to be outfitted with nonstandard hardware having utility only with this type of docking system.

It is, therefore an object of the present invention to provide a new and improved boat mooring system.

It is another object of the present invention to provide an improved boat mooring system which solves the aforementioned problems.

It is a further object of the present invention to provide an improved boat mooring system which is inexpensive, easy to install and reliable.

It still another object of the present invention to provide an improved boat mooring system that may be used to moor any boat using only standard equipment as found on boats.

It is a further object of the present invention to provide an improved boat mooring system that is substantially maintenance free.

SUMMARY OF THE INVENTION

The foregoing objects are accomplished by providing a boat mooring apparatus for connecting a boat to a mooring of the type having a vertical piling. The apparatus comprises an elongate member adapted to be mounted substantially vertically on the piling. The elongate member includes a slot extending along at least a portion of it's length and a carriage means mounted within the slot. A float support has an upper end and a lower end. The upper end is mounted to the carriage means exteriorly of the elongate member and is adapted to receive a mooring line from a boat. A float is connected to the lower end of the float support and floats exterior of the elongate member. A boat mooring means is operatively associated with the carriage means so that when a boat is secured to the apparatus and the tide changes, the relative position of the boat with respect to the boat mooring means remains the same, thereby eliminating the need to constantly adjust the mooring lines.

BRIEF DESCRIPTION OF THE DRAWINGS

Some of the features and advantages of the invention having been briefly described, others will appear from the detailed description which follows, when taken in connection with the accompanying drawings in which.

DETAILED DESCRIPTION OF THE ILLUSTRATED EMBODIMENT

While the present invention will be described more fully hereinafter with reference to the accompanying drawings, in which a particular embodiment is shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention.

Figure 2:
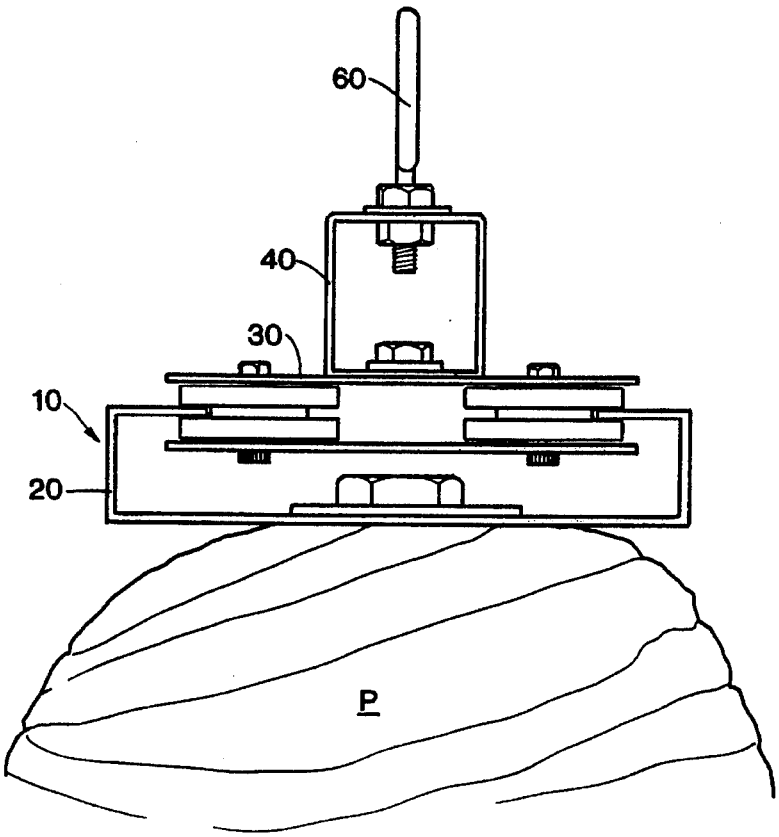
FIG. 2 is a plan view of the boat mooring system according to the present invention.
Figure 1:
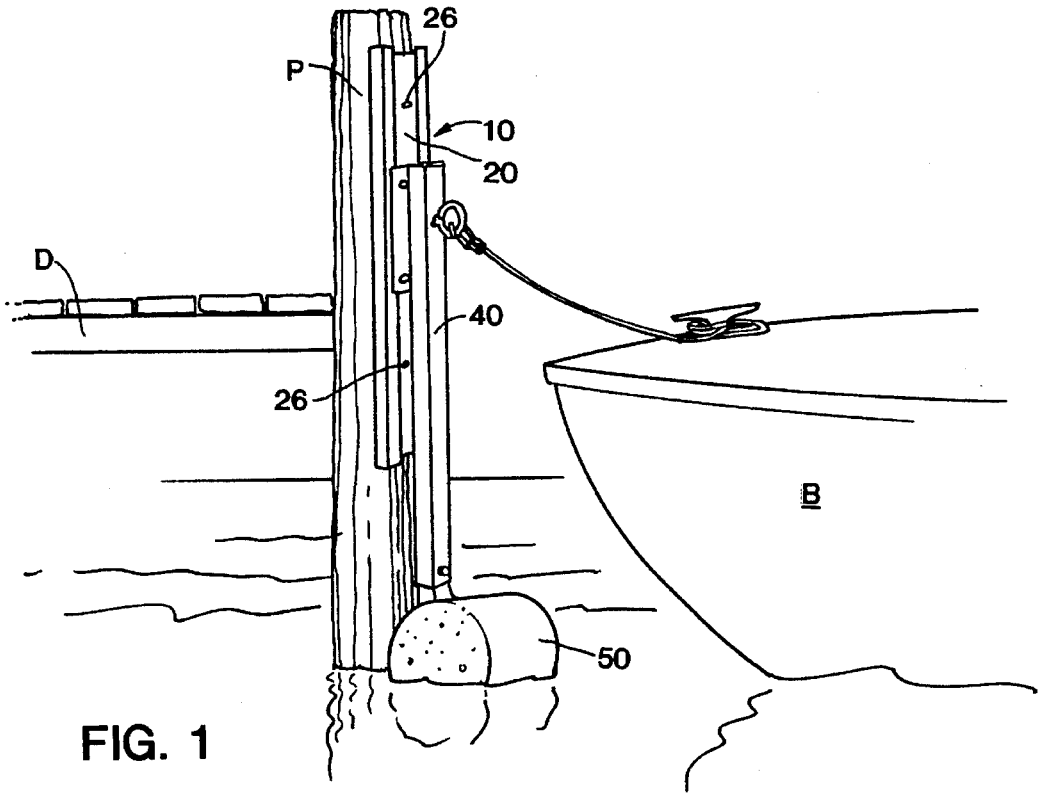
FIG. 1 is a perspective view of the boat mooring system according to the present invention and showing a boat moored to a dock structure.

Referring now to the drawings, and particularly to FIG. 1, the boat mooring system according to the present apparatus is there illustrated. A boat B is shown moored to a piling P which also serves as a support member for a dock D by employing the boat mooring apparatus, generally indicated at 10.

The boat mooring apparatus comprises an elongate member 20 which is adapted to be mounted substantially vertically on the piling P. It is an important aspect of the invention that the member 20 be mounted on the piling in such a way so that it is out of the water, even in the event of the highest expected tide. This feature prevents the growth of aquatic life such as barnacles, sea weed and the like from growing on the apparatus impeding the free movement of the carriage means 30, as will be discussed hereinbelow. The elongate member 20 includes a longitudinal slot or track 22 that extends along at least a portion of it's length. In the illustrated embodiment the elongate member is substantially U-shaped and comprises a back wall 24 and a pair of upstanding side walls 25. In addition, the terminating ends of the side walls are inwardly bent so as to be substantially parallel to the back wall 24. The terminating ends together define the track 22. A plurality of openings 26 are located in the back wall 24 and are adapted to receive mounting bolts or other suitable hardware suitable for securing the member 20 to the piling. The member 20 is fabricated from any material that is structural such as galvanized steel. It is believed that twelve gauge steel is suitable for most boats up to about thirty feet in length.

Figure 4:
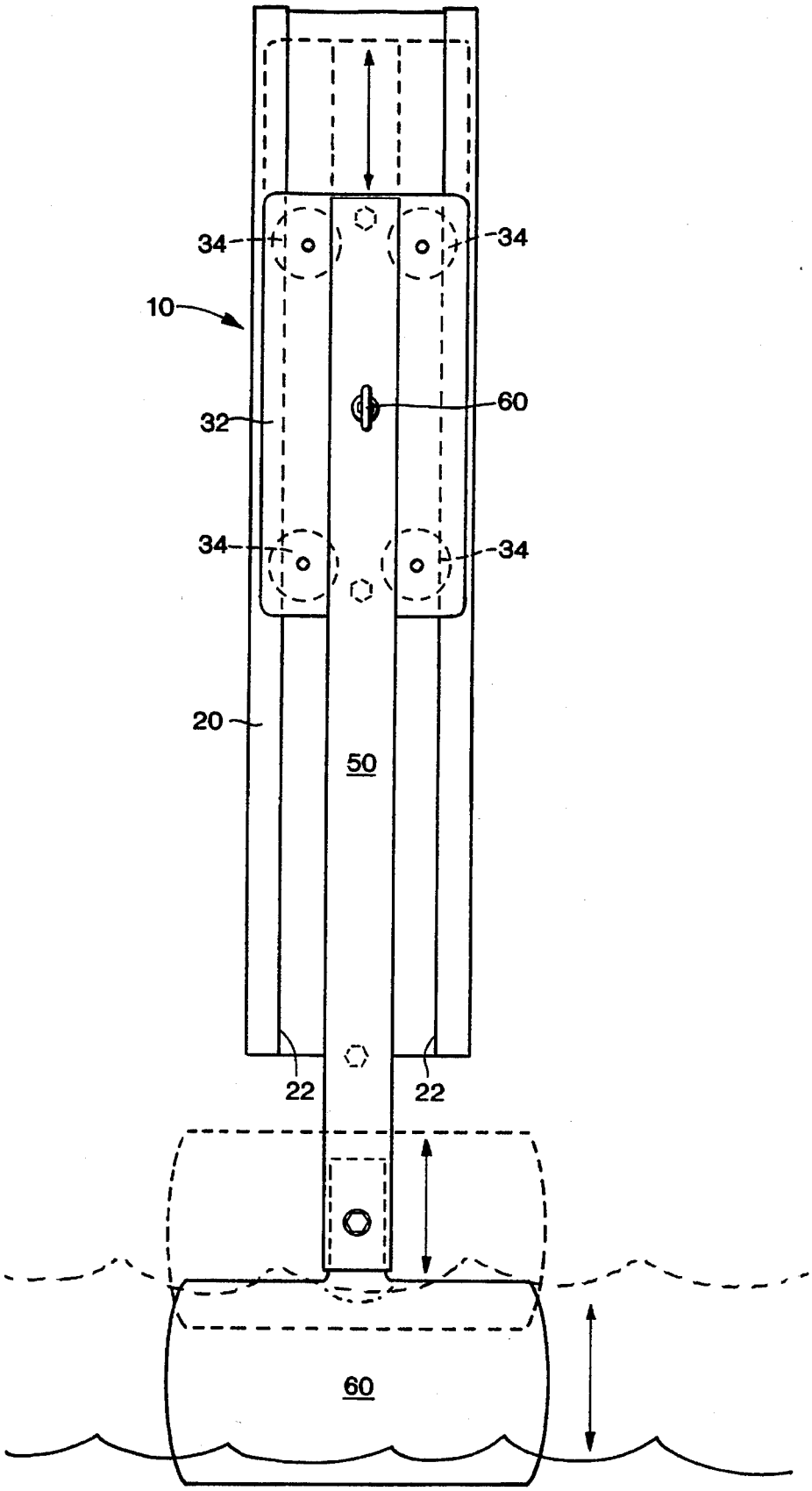
FIG. 4 is an end view of the boat mooring system according to the present invention.
Figure 5:
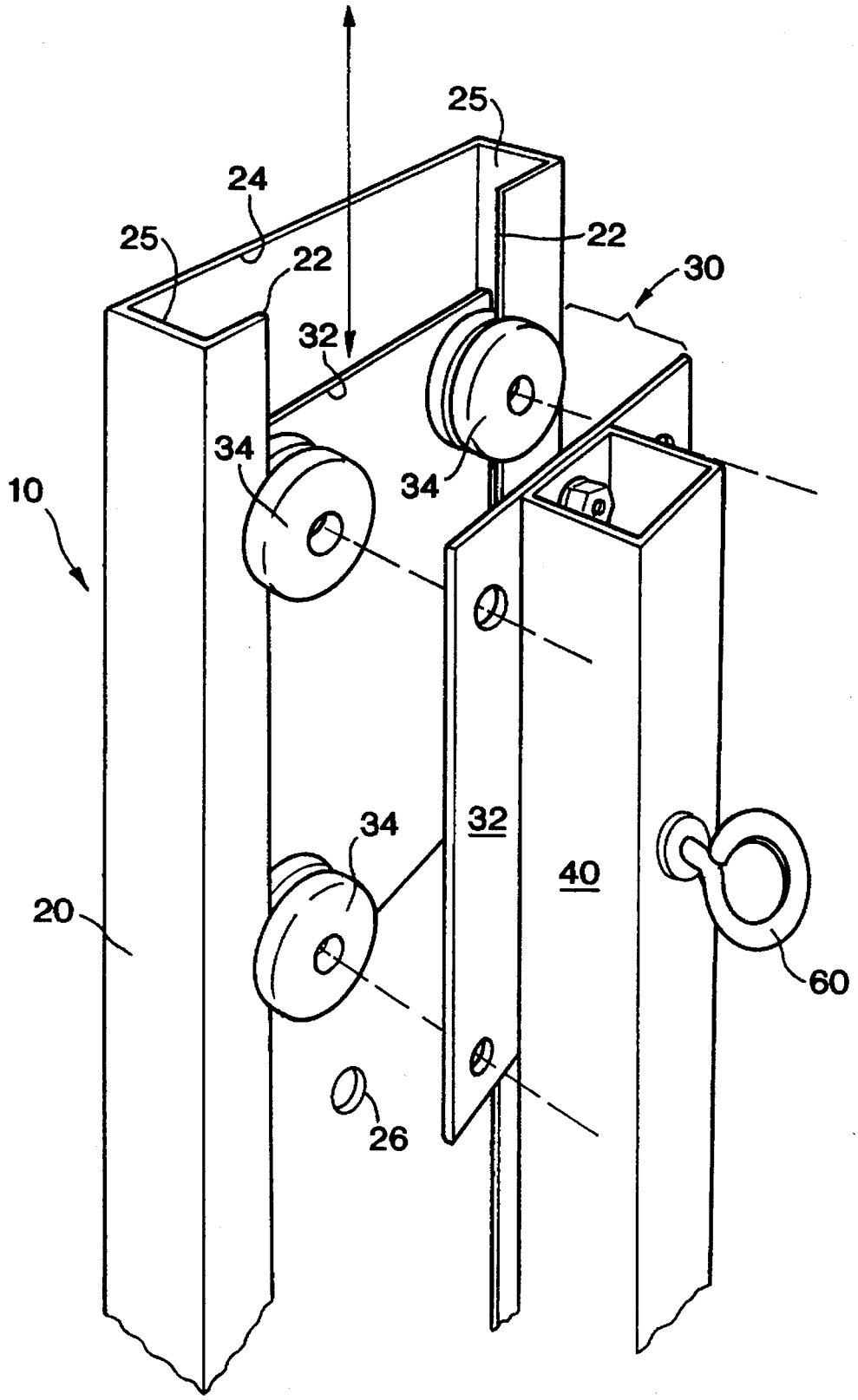
FIG. 5 is an exploded view, taken in perspective of the boat mooring system according to the present invention and illustrating the movable carriage.

A carriage means or carriage 30 is mounted for sliding movement within the track 22 and is moveable along it's length. The carriage 30 comprises a pair of flat plates 32 with rollers 34 being mounted therebetween in sandwich fashion such that the rollers engage the opposite sides of the track. As best illustrated in FIGS. 4 and 5, four rollers are provided, each of which is secured by a nut and bolt that extends through the outer plate, the roller, and the inner plate so that the roller is held therebetween in sandwich fashion. The plates are generally rectangular and are fabricated from twelve gauge galvanized steel. The rollers 34 are preferably fabricated from plastic, such as a PVC type plastic and act as bearings. Thus, with the present system there are no metal parts in contact with each other. This extends the life of the apparatus as the galvanization has an extended life and the onset of rust is postponed.

A float support means 40 comprises an elongate square galvanized steel tube having an upper end and a lower end. The upper end is secured to the carriage 30 exterior of the elongate member by a bolt and corresponding nut (best illustrated in FIGS. 4 and 5). A ring 60 is connected to the tube at its upper end.

Figure 3:
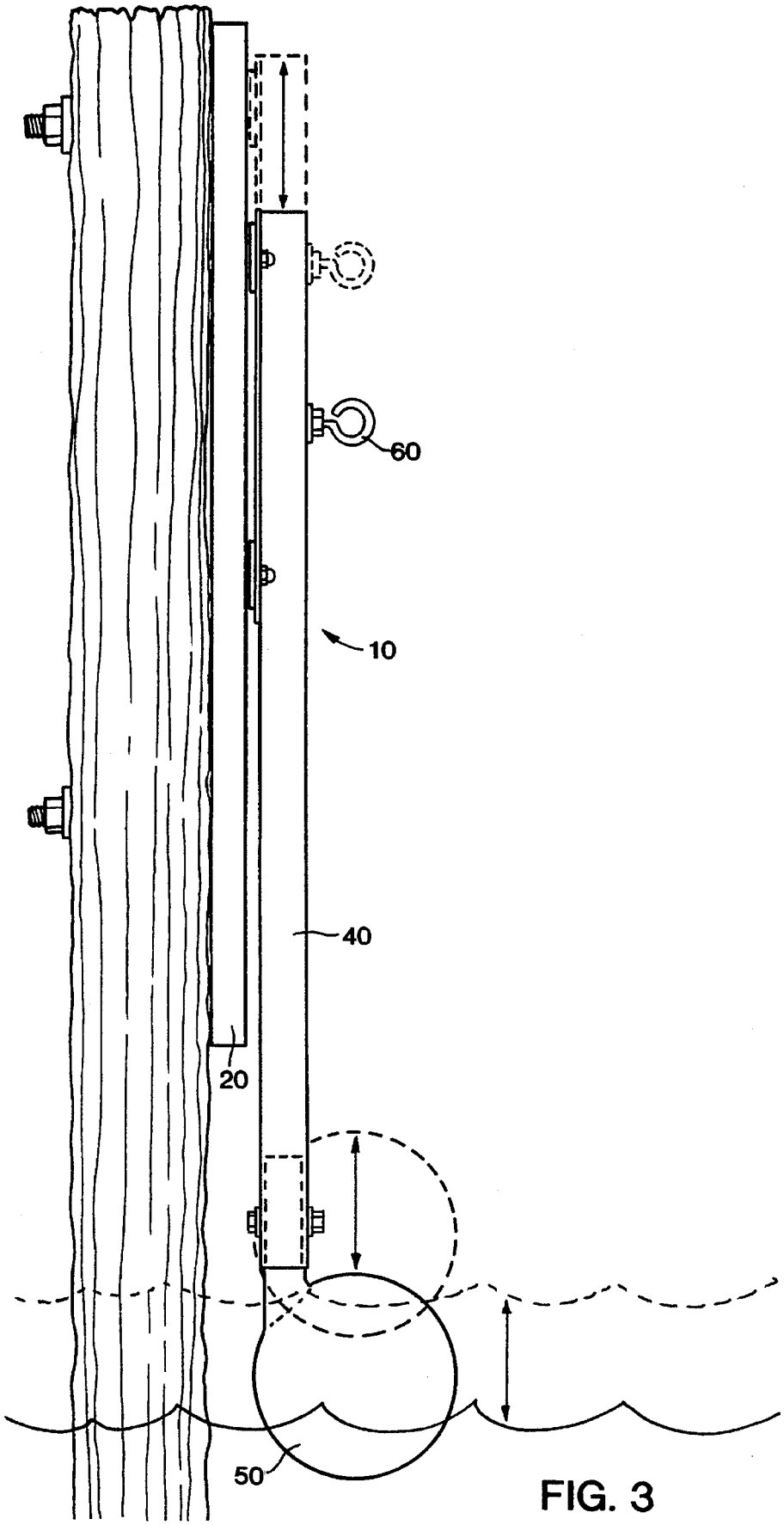
FIG. 3 is a side view of the boat mooring system according to the present invention.

A float means or float 50 is connected to the lower end of the tube 40. The float must have at least sufficient buoyancy to float its own mass as well as that of the tube 40 and the carriage 30. The float 50 is typically an air filled cylinder which would be molded from a suitable flexible plastic or such as that plastic employed in the fabrication of conventional boat bumpers. The float includes a neck which is off center and which is of a dimension that will fit snugly within the lower end of the float support means 40. The float is secured by means of a nut and bolt as shown in FIGS. 1 and 3. It will be noted that the neck portion is offset to maintain the float away from the pier, thereby preventing the moving parts of the invention from chaffing or rubbing against the pier. Furthermore, the float support means 40 transmits the tide forces acting on the float 50 to the carriage 30 in order to adjust the position of the carriage in response to changes in the tide. Thus, it will be seen that the entire apparatus with the exception of the float remains out of the water at all times. This results in a boat mooring system that is relatively maintenance free in that barnacles, sea weed and the like will not grow thereon.

Figure 6:
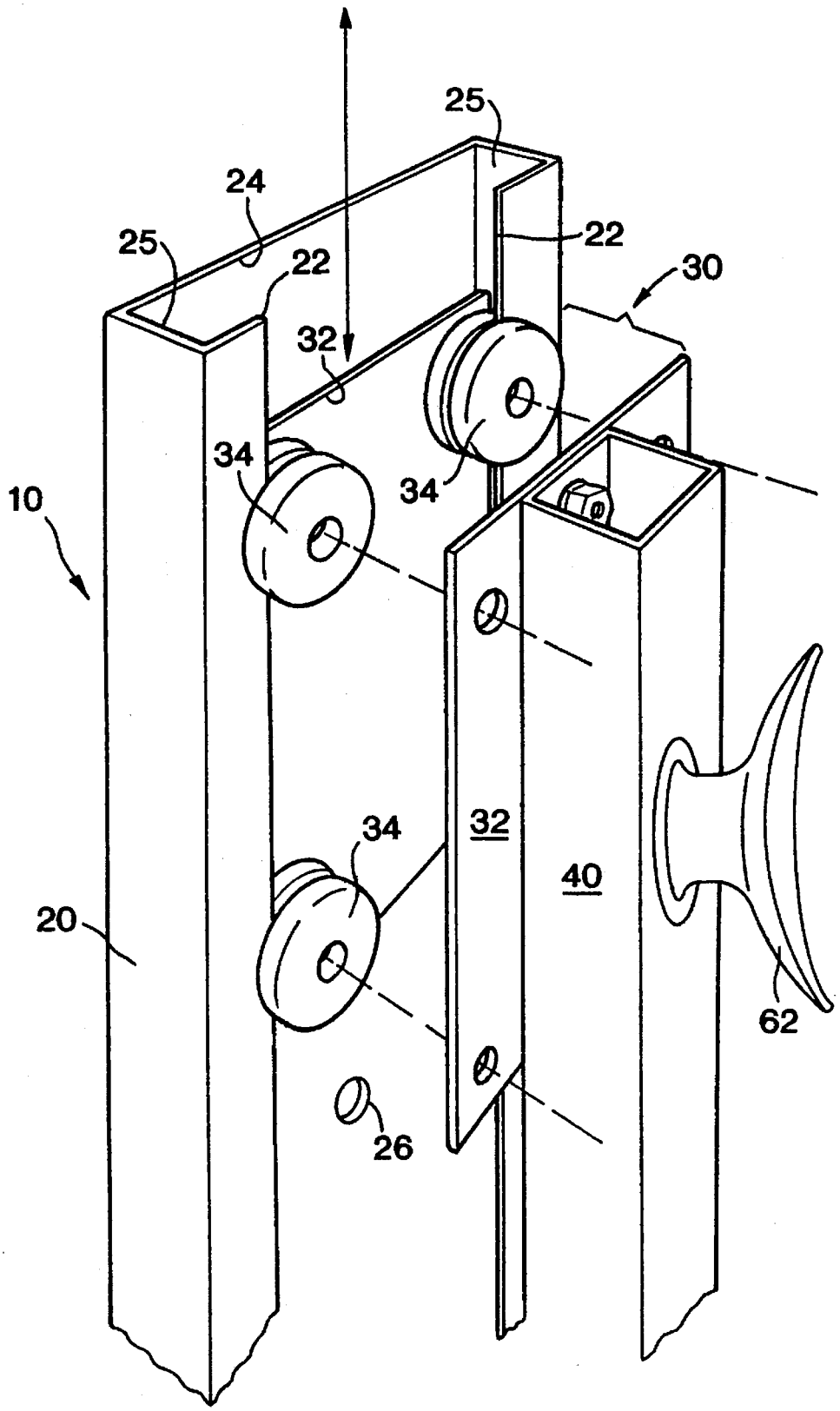
FIG. 6 is an exploded view, taken in perspective of a second embodiment of the boat mooring system according to the present invention and illustrating the movable carriage mounting a cleat.

In operation, an elongate member of sufficient length is selected based on the tide swing and is secured via suitable means to the pilings of a dock or the like. Thereafter, a the carriage 30 with float 50 attached thereto is mounted for sliding movement within track 22. A stop (not shown) may thereafter be placed at the top and bottom of the track in order to prevent the carriage 30 from inadvertently sliding out of the track 22. A line of suitable length and thickness for the boat to be moored is attached to ring 60 or cleat 62 (FIG. 6) and may be extended as shown in FIG. 1 to moor the boat thereto. The boat will then float up and down with the tube and the strain on the mooring lines will be the same at all times.

It will be noted that while the figures illustrate a boat being moored with only a single line. It is to be considered within the scope of the invention that any and all lines extending between a dock or a piling or similar structure can be used in combination with the present boat mooring system.

The present invention, of course may be carried out in other specific ways than those herein set forth without departing from the spirit and essential characteristics of the invention. The present embodiment is therefore, to be considered in all respects as illustrative and not restrictive, in all respects as illustrative and not restrictive, and all changes coming within the meaning and equivalency range of the appended claims are intended to be embraced therein.

That which is claimed is:

1. A boat mooring apparatus for connecting a boat to a mooring location having a high water mark and a low water mark and comprising:

an elongate member adapted to be mounted substantially vertically on the mooring location above the high water mark, said elongate member including a longitudinal slot defining a channel extending along at least a portion of it's length;

a carriage means mounted for sliding movement within said slot, said carriage means comprising a pair of flat plates with rollers being mounted therebetween in sandwich fashion such that said rollers engage the respective opposite sides of said slot, said carriage means being movable along the length of said slot;

an elongate float support means having an upper end and a lower end, said lower end mounting a float means and said upper end being mounted to said carriage means in substantial parallel relation to said elongate member, said float support means being positioned so as to overlie substantially the entire carriage means, and further, wherein said float support means is constructed and arranged to transmit the tide forces acting on said float means to said carriage means in order adjust the position of the carriage in response thereto, said carriage means being adapted to receive a mooring line from a boat;

boat mooring means operatively associated with said carriage means; and wherein said float means is movable between the high water mark and the low water mark and further wherein the ,movement of the float means is limited to being below the lower end of the elongate member;

whereby the relative position of the boat and the mooring location remains the same independent of the tide.

2. The boat mooring apparatus according to claim 1 wherein said boat mooring means comprises a ring.

3. The boat mooring apparatus according to claim 1 wherein said carriage means comprises a pair of plates having a plurality of bearings positioned therebetween in sandwich fashion and wherein said bearings bear on the respective opposite sides of said slot.

4. The boat mooring apparatus according to claim 3 wherein said bearings comprise rollers that are adapted to rollably engage the respective opposite side of said slot.

5. The boat mooring apparatus according to claim 1 wherein said carriage means comprises a pair of rectangular plates having a pair of roller bearings in cooperating contacting relation with each side of said slot.

6. A boat mooring apparatus for connecting a boat to a mooring location having a high water mark and a low water mark and comprising:

an elongate member adapted to be mounted substantially vertically on the mooring location, said elongate member being substantially U-shaped and comprising a back and a pair of upstanding sidewalls and further wherein the terminating ends of said side walls are inwardly bent so as to be substantially parallel to said back wall, said inwardly bent terminating ends together defining a track;

a carriage means mounted for sliding movement within said track, said carriage means comprising a pair of flat plates with rollers being mounted therebetween in sandwich fashion such that said rollers engage the respective opposite sides of said track, said carriage means being movable along the length of said track;

an elongate float support means having an upper end and a lower end, said lower end mounting a float means and said upper end being mounted to the exterior of said carriage means in substantial parallel relation to said elongate member, said float support means being positioned so as to overlie substantially the entire carriage means, and further, wherein said float support means is constructed and arranged to transmit the tide forces acting on said float means to said carriage means in order to adjust the position of the carriage in response thereto;

boat mooring means operatively associated with said carriage means; and wherein said float means is movable between the high water mark and the low water mark and further wherein the movement of the float means is limited to being below the lower end of the elongate member:

whereby the relative position of the boat and the mooring location remains the same independent of the tide.

7. The boat mooring apparatus according to claim 6 wherein said boat mooring apparatus comprises a ring.

8. The boat mooring apparatus according to claim 6 wherein said boat mooring apparatus comprises a cleat.

9. The boat mooring apparatus according to claim 6 wherein said carriage means comprises at least one roller positioned within said track for movement therealong.

10. The boat mooring apparatus according to claim 6 wherein said carriage means comprises a pair of plates having a plurality of bearings positioned therebetween in sandwich fashion and wherein said bearings bear on the respective opposite sides of said track.

11. The boat mooring apparatus according to claim 10 wherein said bearings comprise rollers that are adapted to rollaby engage the opposite sides of said track.

12. The boat mooring apparatus according to claim 6 wherein said carriage means comprises a pair of rectangular plates having a pair of roller bearings in cooperating contacting relation with the respective opposite sides of said track.

13. The boat mooring apparatus according to claim 6 wherein said float support means comprises an elongate tube.

14. A boat mooring apparatus for connecting a boat to a mooring location having a high water mark and a low water mark and comprising:

an elongate member adapted to be mounted substantially vertically on a piling, said elongate member being substantially U-shaped and comprising a back and a pair of upstanding side walls and further wherein the terminating ends of said side walls are inwardly bent so as to be substantially parallel to said back wall, said inwardly bent terminating ends together defining a track;

a carriage means mounted for sliding movement within said track, said carriage means comprising a pair of flat plates with rollers being mounted therebetween in sandwich fashion such that said rollers engage the respective opposite sides of said track, an elongate rod having and upper end and a lower end and extending substantially parallel to the mooring location, said lower end mounting a float and wherein said upper end is connected to and overlies substantially the entire the exterior of said carriage means so that the elongate rod transmits the tide forces acting on the float to the carriage in order to adjust the position of the carriage in response to the tide forces acting thereon;

a boat mooring means operatively associated with said carriage means; and wherein said float is movable between the high water mark and the low water mark and further wherein the movement of the float is limited to being below the lower end of the elongate member;

whereby the relative position of the boat and the mooring location remains the same independent of the tide.

15. The boat mooring apparatus according to claim 14 wherein said boat mooring means is connected to said elongate rod.

16. The boat mooring apparatus according to claim 14 wherein said boat mooring means is connected to said carriage means.

* * * * *